US011448117B2

(12) United States Patent
Bartlett

(10) Patent No.: US 11,448,117 B2
(45) Date of Patent: Sep. 20, 2022

(54) AUXILIARY COOLANT PUMP WITH BYPASS

(71) Applicant: Matthew T Bartlett, Northville, MI (US)

(72) Inventor: Matthew T Bartlett, Northville, MI (US)

(73) Assignee: FCA US LLC, Auburn Hills, MI (US)

( * ) Notice: Subject to any disclaimer, the term of this patent is extended or adjusted under 35 U.S.C. 154(b) by 0 days.

(21) Appl. No.: 17/165,086

(22) Filed: Feb. 2, 2021

(65) Prior Publication Data

US 2022/0243641 A1 Aug. 4, 2022

(51) Int. Cl.

| | |
|---|---|
| ***F01P 7/16*** | (2006.01) |
| ***F01P 5/12*** | (2006.01) |
| *F01P 7/14* | (2006.01) |
| *F01P 5/10* | (2006.01) |

(52) U.S. Cl.

CPC ..... *F01P 7/161* (2013.01); *F01P 5/12* (2013.01); *F01P 2005/105* (2013.01); *F01P 2007/146* (2013.01); *F01P 2037/02* (2013.01)

(58) Field of Classification Search

CPC ..... F01P 7/161; F01P 5/12; F01P 2005/105; F01P 2007/146; F01P 2037/02

USPC ..... 123/41.09

See application file for complete search history.

(56) References Cited

U.S. PATENT DOCUMENTS

| | | | | |
|---|---|---|---|---|
| 6,732,942 | B1 * | 5/2004 | Sangwan | F02D 19/0671 165/41 |
| 9,222,398 | B2 | 12/2015 | Mehring et al. | |
| 10,035,404 | B2 | 7/2018 | Patel et al. | |
| 10,161,361 | B2 | 12/2018 | Quix et al. | |
| 2012/0111291 | A1 * | 5/2012 | Popp | F01P 7/162 123/41.09 |
| 2015/0176472 | A1 * | 6/2015 | Hutchins | F01P 7/165 701/102 |
| 2018/0038074 | A1 * | 2/2018 | Nishihata | E02F 9/226 |
| 2019/0021210 | A1 * | 1/2019 | Fast | A01B 59/04 |
| 2020/0370463 | A1 * | 11/2020 | Saruwatari | B63H 20/28 |

FOREIGN PATENT DOCUMENTS

| | | | |
|---|---|---|---|
| DE | 102009036603 | A1 | 2/2011 |
| DE | 102010015107 | A1 | 10/2011 |

* cited by examiner

*Primary Examiner* — Yi-Kai Wang
(74) *Attorney, Agent, or Firm* — Ralph E. Smith

(57) ABSTRACT

An auxiliary coolant pump for circulating a coolant in a vehicle thermal system having a main coolant pump includes a housing, an impeller, a motor selectively driving the impeller, a coolant inlet configured to receive the coolant, a coolant outlet fluidly coupled to the coolant inlet, and a bypass passage fluidly coupled between the coolant inlet and the coolant outlet. When the main coolant pump is on, the auxiliary coolant pump is selectively turned off such that coolant flows through the bypass passage to reduce or eliminate restriction of the coolant flow rate in the thermal system. When the main coolant pump is off, the auxiliary coolant pump is selectively turned on such that coolant continues to flow through at least a portion of the thermal system.

18 Claims, 3 Drawing Sheets

AUXILIARY COOLANT PUMP WITH BYPASS

FIELD

The present application relates generally to vehicle thermal systems and, more particularly, to a vehicle thermal system having an auxiliary coolant pump with bypass.

BACKGROUND

Conventional vehicles typically include an engine mounted coolant pump to circulate hot coolant from the engine through the heater core to defrost the windshield and heat the cabin. Some vehicles include an automatic stop/start function to reduce fuel consumption when the vehicle is stopped. However, the automatic stop feature is potentially overridden when the cabin is cold and occupants require heat. Thus, the engine continues to run and fuel consumed in order to heat the cabin. Other pumps have been utilized to maintain coolant flow during engine off, but must be run during engine on to prevent becoming a restriction in the circuit, thus consuming electrical power. Accordingly, while such conventional cooling systems work for their intended purpose, it is desirable to provide improvement in the relevant art.

SUMMARY

According to one example aspect of the invention, an auxiliary coolant pump for circulating a coolant in a vehicle thermal system having a main coolant pump is provided. In one exemplary implementation, the auxiliary coolant pump includes a housing, an impeller, a motor selectively driving the impeller, a coolant inlet configured to receive the coolant, a coolant outlet fluidly coupled to the coolant inlet, and a bypass passage fluidly coupled between the coolant inlet and the coolant outlet. When the main coolant pump is on, the auxiliary coolant pump is selectively turned off such that coolant flows through the bypass passage to reduce or eliminate restriction of the coolant flow rate in the thermal system. When the main coolant pump is off, the auxiliary coolant pump is selectively turned on such that coolant continues to flow through at least a portion of the thermal system.

In addition to the foregoing, the described auxiliary coolant pump may include one or more of the following features: wherein the bypass passage is integral with the housing; a valve disposed within the bypass passage to facilitate preventing fluid flow from the coolant outlet to the coolant inlet, and allowing fluid flow from the coolant inlet to the coolant outlet; wherein the valve includes a check ball and valve seat; wherein the valve is a flapper valve; a controller configured to selectively operate the motor to drive the impeller, wherein the controller is configured to operate the motor when an engine of the vehicle is off and the vehicle thermal system demands vehicle cabin heating; and a controller configured to selectively operate the motor to drive the impeller, wherein the controller is configured to operate the motor during a cold start when coolant flow stagnation is desired in an engine of the vehicle for rapid heating thereof.

According to another example aspect of the invention, a thermal system for a vehicle is provided. In one exemplary implementation, the thermal system includes a coolant circuit configured to thermally couple to a vehicle engine for cooling thereof, a main coolant pump configured to circulate coolant through the coolant circuit, a heat exchanger thermally coupled to the coolant circuit, and an auxiliary coolant pump. The auxiliary coolant pump includes an impeller configured to circulate coolant through the coolant circuit, and a housing defining a coolant inlet, a coolant outlet, and a bypass passage fluidly coupled between the inlet and the outlet. When the main coolant pump is on, the auxiliary coolant pump is selectively turned off such that coolant flows through the bypass passage to reduce or eliminate restriction of the coolant flow rate in the coolant circuit. When the main coolant pump is off, the auxiliary coolant pump is selectively turned on to continue to provide coolant flow to the heat exchanger.

In addition to the foregoing, the described thermal system may include one or more of the following features: a valve disposed within the bypass passage to facilitate preventing fluid flow from the coolant outlet to the coolant inlet; wherein the valve allows fluid flow from the coolant inlet to the coolant outlet; wherein the heat exchanger is a cabin heat exchanger configured to provide heating to a cabin of the vehicle, wherein the main coolant pump is turned off and the auxiliary coolant pump is turned on when the vehicle engine is stopped during a stop/start mode; and wherein the heat exchanger is configured to provide heating to a component of the thermal system, wherein the main coolant pump is turned off during a cold start to provide coolant flow stagnation in the vehicle engine for rapid heating thereof, and the auxiliary coolant pump is turned on to continue to provide coolant flow to the heat exchanger.

In addition to the foregoing, the described thermal system may include one or more of the following features: wherein the coolant circuit is a high temperature circuit having a first branch conduit and a second branch conduit; a high temperature radiator thermally coupled to the first branch conduit; wherein the heat exchanger is a cabin heat exchanger thermally coupled to the second branch conduit; a thermostat coupled to the high temperature circuit and configured to receive coolant flow from the engine; wherein the first branch conduit is fluidly coupled between the thermostat and the main coolant pump; and wherein the second branch conduit is fluidly coupled between the thermostat and the main coolant pump.

Further areas of applicability of the teachings of the present disclosure will become apparent from the detailed description, claims and the drawings provided hereinafter, wherein like reference numerals refer to like features throughout the several views of the drawings. It should be understood that the detailed description, including disclosed embodiments and drawings references therein, are merely exemplary in nature intended for purposes of illustration only and are not intended to limit the scope of the present disclosure, its application or uses. Thus, variations that do not depart from the gist of the present disclosure are intended to be within the scope of the present disclosure.

DETAILED DESCRIPTION

Described herein is a vehicle thermal system with an auxiliary coolant pump having an integrated bypass. The auxiliary coolant pump is disposed between the heater core and the engine and is configured to selectively circulate hot coolant from the engine and maintain cabin comfort and defrost safety even with the engine shut off. The system is configured to operate the auxiliary coolant pump only when the engine and/or main coolant pump is off and allows coolant flow from the main pump to pass through the bypass when the engine is running without restricting the heater core coolant flow rate.

Figure 1:
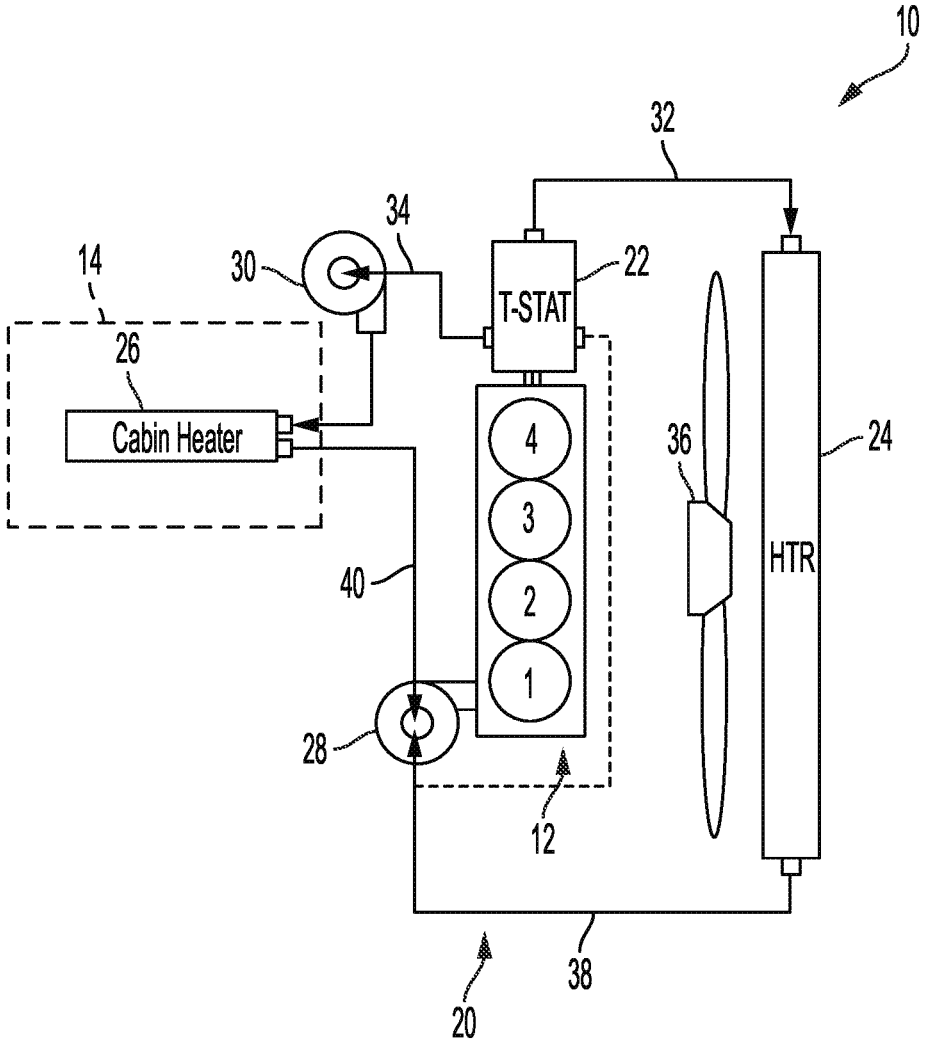
FIG. 1 is a schematic view of an example vehicle thermal system in accordance with the principles of the present disclosure.

With initial reference to FIG. 1, an example vehicle thermal system is illustrated and generally identified at reference numeral 10. The thermal system 10 is configured to provide heating/cooling to various components of the vehicle such as a vehicle engine 12 and a vehicle cabin 14. The thermal system 10 includes a high temperature circuit 20 configured to circulate a heat transfer fluid or coolant (e.g., water, ethylene glycol, etc.) therein. As shown in the illustrated example, the high temperature circuit 20 generally includes a thermostat 22, a high temperature radiator 24, a cabin heat exchanger 26, a main coolant pump 28, and an auxiliary coolant pump 30 with an integrated bypass. As described herein in more detail, the coolant is heated by engine 12 and is subsequently supplied through thermostat 22 to a first branch conduit 32 and a second branch conduit 34.

In the example embodiment, the first branch conduit 32 directs heated coolant to the high temperature radiator 24, where the heated coolant is cooled by ambient air and/or an airflow created by a fan 36. The coolant is then directed to the main coolant pump 28 via a first coolant return line 38. The second branch conduit 34 directs the heated coolant to the auxiliary coolant pump 30 and subsequently to the cabin heat exchanger 26 where thermal energy of the heated coolant is used to provide heating to the vehicle passenger cabin (not shown). The cooled coolant is then directed to the main coolant pump 28 via a second coolant return line 40.

The main coolant pump 28 is disposed within the high temperature circuit 20 and is configured to receive coolant from the first and second coolant return lines 38, 40. When operating, the main coolant pump 28 is configured to circulate the coolant around the high temperature circuit 20. In the example embodiment, the coolant may be selectively supplied to branch conduits 32 and/or 34 such that each of the branch conduits may be used alone or in combination. As such, main coolant pump 28 supplies the cooled coolant to the engine 12 to provide cooling thereto.

Figure 2:
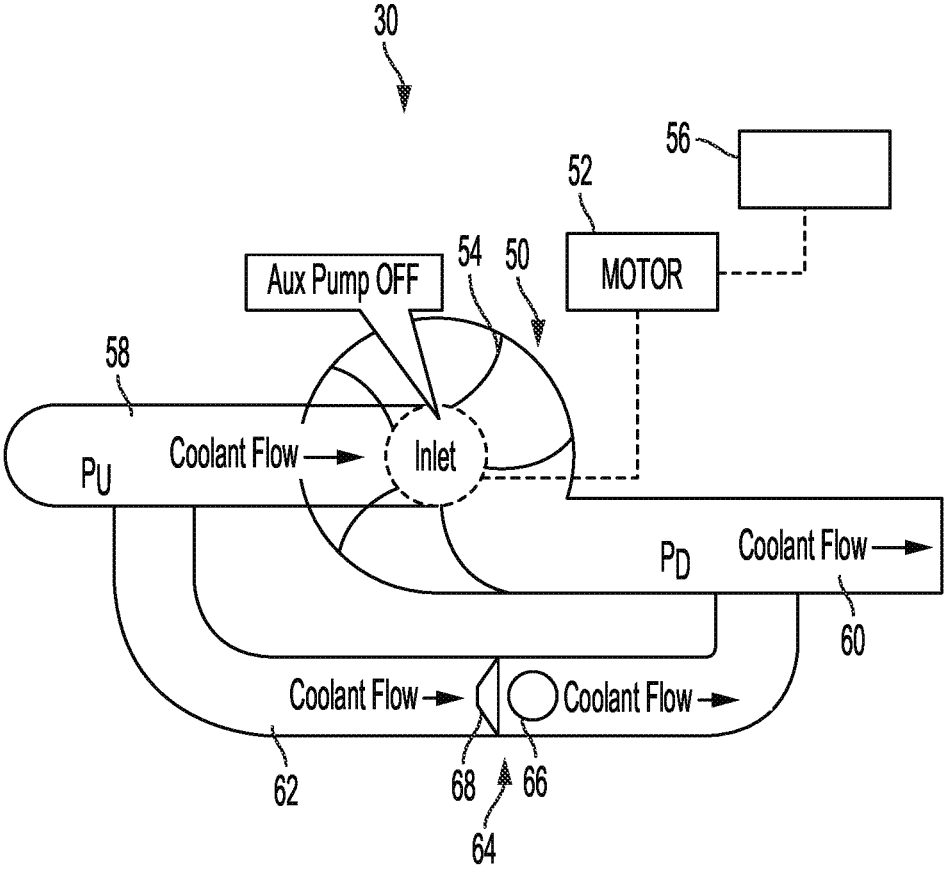
FIG. 2 is a schematic illustration of an example auxiliary coolant pump of the system shown in FIG. 1, in an OFF condition, in accordance with the principles of the present disclosure.

With additional reference to FIGS. 2 and 3, the low powered auxiliary coolant pump 30 with integrated bypass will be described in more detail. In the example embodiment, the auxiliary coolant pump 30 generally includes a housing 50, a motor 52 driving an impeller 54, and a controller 56 in signal communication with the motor 52 for control thereof. As used herein, the term controller refers to an application specific integrated circuit (ASIC), an electronic circuit, a processor (shared, dedicated, or group) and memory that executes one or more software or firmware programs, a combinational logic circuit, and/or other suitable components that provide the described functionality.

In the example embodiment, the pump housing 50 defines a coolant inlet 58 fluidly coupled to a coolant outlet 60, which are configured to couple to hoses, conduits, etc. of the second branch conduit 34. Advantageously, the auxiliary coolant pump housing 50 includes a bypass passage 62 fluidly coupled between the coolant inlet 58 and the coolant outlet 60. A valve 64 is disposed within bypass passage 62 and is configured to allow bypass flow from the coolant inlet 58 to the coolant outlet 60, but prevent reverse flow from the coolant outlet 60 to the coolant inlet. In the illustrated example, valve 64 is a check valve with a check ball 66 configured to selectively seat within a valve seat 68. However, it will be appreciated that valve 64 may be any suitable valve that enables auxiliary coolant pump 30 to function as described herein such as, for example, a flapper valve.

With continued reference to FIGS. 2 and 3, an example operation of thermal system 10 and auxiliary coolant pump 30 will be described. FIG. 2 illustrates an example normal mode where main coolant pump 28 is ON and auxiliary coolant pump 30 is OFF. Controller 56 operates in this mode, for example, when the engine 12 is running but the auxiliary coolant pump 30 is not required. In this mode, the upstream fluid pressure ($P_U$) in coolant inlet 58 is greater than the downstream fluid pressure ($P_D$) in coolant outlet 60. This pressure difference forces the check ball 66 out of the valve seat 68 allowing coolant flow through the bypass passage 62 and a small amount (e.g., a trickle) through the impeller 54. Accordingly, the impeller 54 causes little or no restriction to the intended coolant flow, and the auxiliary coolant pump 30 can be turned off to reduce power consumption.

Figure 3:
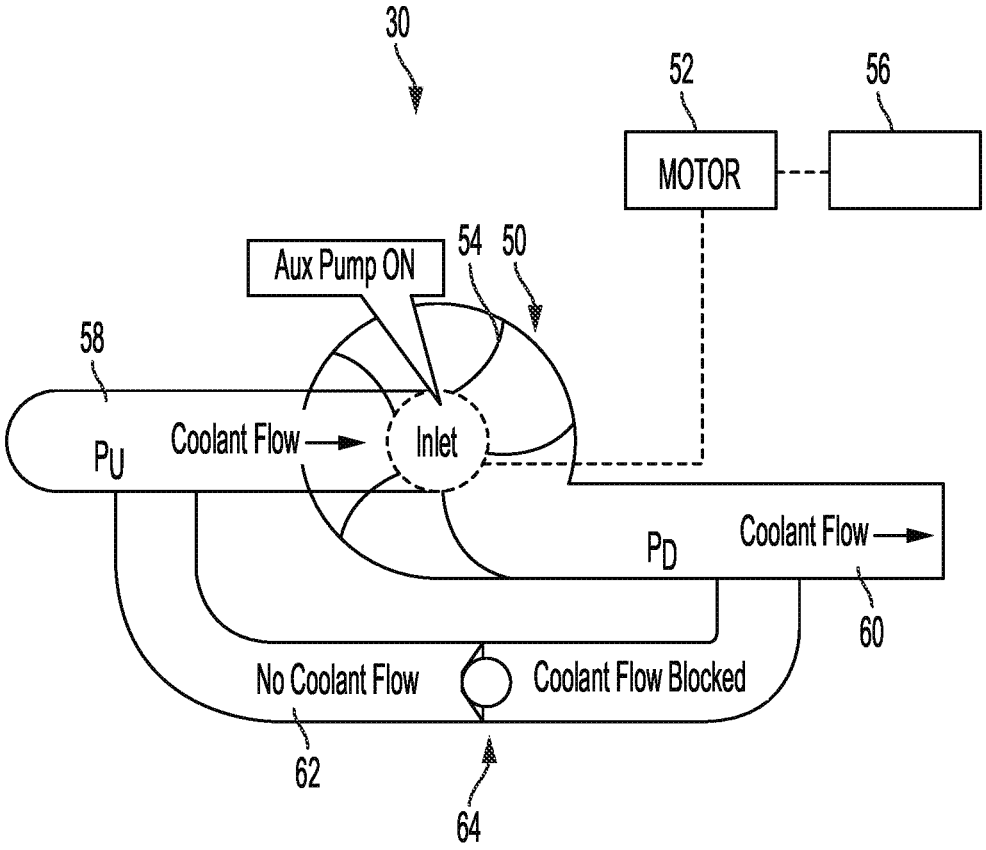
FIG. 3 is a schematic diagram of the auxiliary coolant pump shown in FIG. 2, in an ON condition, in accordance with the principles of the present disclosure.

FIG. 3 illustrates an example bypass mode where main coolant pump 28 is OFF and auxiliary coolant pump 30 is ON. Controller 56 operates in this mode, for example, when the engine 12 is shut off but heating is requested by the cabin or defroster, thus allowing heating to continue while reducing fuel consumption by turning off engine 12. In this mode, the motor 52 is powered to drive impeller 54 and pump coolant from the coolant inlet 58 to the coolant outlet 60. In this operation, the upstream fluid pressure ($P_U$) in coolant inlet 58 is less than the downstream fluid pressure ($P_D$) in coolant outlet 60. This pressure difference forces the check ball 66 into the valve seat 68 and blocks coolant return flow in the coolant outlet 60 back to the coolant inlet 58. Accordingly, coolant can continue to flow to the cabin heat exchanger 26 while the engine is off to thereby reduce fuel consumption.

Further, it will be appreciated that auxiliary coolant pump 30 is not limited to use in the high temperature circuit 20 and may be utilized in various other thermal systems or vehicle systems. For example, in one additional or alternative implementation, it may be desirable to reduce fuel consumption following a cold start by keeping coolant flow stagnant in the cylinder block and head of the engine 12 for a predetermined time (e.g., 1-2 minutes). This facilitates quicker warm-up of the metal and helps to reduce engine friction and fuel consumption. Some of these engines may be equipped with EGR cooler and/or engine oil heat exchangers (not shown). In the case where it is desirable to provide coolant flow in the EGR cooler and/or engine oil heat exchanger following the cold start, one of auxiliary coolant pumps 30 may be provided in the coolant circuit thereof to provide coolant flow only in this portion of the cooling circuit in the brief period after the cold start.

Once the engine 12 has passed through the coolant stagnation period, the main coolant pump 28 is activated and coolant flow is established throughout the entire high temperature circuit 20, including the second branch conduit 34 with the auxiliary coolant pump 30. In this mode of operation, the auxiliary coolant pump 30 would typically act as a restriction to the intended coolant flow unless the auxiliary coolant pump 30 was powered. However, the bypass passage 62 enables the auxiliary coolant pump 30 to be turned off when the main coolant pump 28 is operational, thereby reducing energy consumption.

In another additional or alternative implementation, it may be desirable to utilize auxiliary coolant pump 30 for cooling turbocharger (not shown) after the engine 12 is shut off. For example, when a very hot engine is shut off (e.g., after towing a trailer), the turbocharger potentially requires coolant flow to avoid overheating during a predetermined time (e.g., 1-2 minutes) after shut off. In such an example, the vehicle continues to operate the auxiliary coolant pump 30 to provide coolant flow to the turbocharger.

Described herein are system and methods for providing additional functionality to vehicle thermal systems by utilizing an auxiliary coolant pump with an integrated bypass. During engine stop/start mode, when cabin heating is required, the engine can be shut off and coolant can still be circulated with the auxiliary coolant pump. Additionally, during engine cold start mode, with coolant stagnation in the engine for rapid warming, the auxiliary coolant pump can be operated to sustain any thermal system components which require constant coolant flow rate even while the cylinder block and head have no flow. In other modes, the auxiliary coolant pump is deactivated, and coolant flow is allowed through the integrated bypass to avoid any unnecessary circuit pressure loss or electrical power consumption.

It will be understood that the mixing and matching of features, elements, methodologies, systems and/or functions between various examples may be expressly contemplated herein so that one skilled in the art will appreciate from the present teachings that features, elements, systems and/or functions of one example may be incorporated into another example as appropriate, unless described otherwise above. It will also be understood that the description, including disclosed examples and drawings, is merely exemplary in nature intended for purposes of illustration only and is not intended to limit the scope of the present disclosure, its application or uses. Thus, variations that do not depart from the gist of the present disclosure are intended to be within the scope of the present disclosure.

What is claimed is:

1. An auxiliary coolant pump for circulating a coolant in a vehicle thermal system having a main coolant pump, the auxiliary coolant pump comprising:

a housing and an impeller;

a motor selectively driving the impeller;

a coolant inlet configured to receive the coolant, and a coolant outlet fluidly coupled to the coolant inlet; and an internal bypass passage disposed within the housing and fluidly coupled between the coolant inlet and the coolant outlet to bypass the impeller, wherein when the main coolant pump is on, the auxiliary coolant pump is selectively turned off such that coolant flows through the bypass passage to reduce or eliminate restriction of the coolant flow rate in the thermal system, and wherein when the main coolant pump is off, the auxiliary coolant pump is selectively turned on such that coolant continues to flow through at least a portion of the thermal system.

2. The auxiliary coolant pump of claim 1, further comprising a valve disposed within the internal bypass passage to facilitate preventing fluid flow from the coolant outlet to the coolant inlet, and allowing fluid flow from the coolant inlet to the coolant outlet.

3. The auxiliary coolant pump of claim 2, wherein the valve includes a check ball and valve seat.

4. The auxiliary coolant pump of claim 2, wherein the valve is a flapper valve.

5. The auxiliary coolant pump of claim 1, further comprising a controller configured to selectively operate the motor to drive the impeller, wherein the controller is configured to operate the motor when an engine of the vehicle is off and the vehicle thermal system demands passenger cabin heating.

6. The auxiliary coolant pump of claim 1, further comprising a controller configured to selectively operate the motor to drive the impeller, wherein the controller is configured to operate the motor during a cold start when coolant flow stagnation is desired in an engine of the vehicle for rapid heating thereof.

7. A thermal system for a vehicle, the thermal system comprising:

a coolant circuit configured to thermally couple to a vehicle engine for cooling thereof;

a main coolant pump configured to circulate coolant through the coolant circuit;

a heat exchanger thermally coupled to the coolant circuit; and an auxiliary coolant pump having an impeller configured to circulate coolant through the coolant circuit, and a housing defining a coolant inlet, a coolant outlet, and an internal bypass passage fluidly coupled between the inlet and the outlet to bypass the impeller, wherein when the main coolant pump is on, the auxiliary coolant pump is selectively turned off such that coolant flows through the bypass passage to reduce or eliminate restriction of the coolant flow rate in the coolant circuit, and wherein when the main coolant pump is off, the auxiliary coolant pump is selectively turned on to continue to provide coolant flow to the heat exchanger.

8. The thermal system of claim 7, further comprising a valve disposed within the internal bypass passage to facilitate preventing fluid flow from the coolant outlet to the coolant inlet.

9. The thermal system of claim 8, wherein the valve allows fluid flow from the coolant inlet to the coolant outlet.

10. The thermal system of claim 7, wherein the heat exchanger is a cabin heat exchanger configured to provide heating to a passenger cabin of the vehicle, wherein the main coolant pump is turned off and the auxiliary coolant pump is turned on when the vehicle engine is stopped during a stop/start mode.

11. The thermal system of claim 7, wherein the heat exchanger is configured to provide heating to a component of the thermal system, wherein the main coolant pump is turned off during a cold start to provide coolant flow stagnation in the vehicle engine for rapid heating thereof, and the auxiliary coolant pump is turned on to continue to provide coolant flow to the heat exchanger.

12. The thermal system of claim 7, wherein the coolant circuit is a high temperature circuit having a first branch conduit and a second branch conduit.

13. The thermal system of claim 12, further comprising a high temperature radiator thermally coupled to the first branch conduit.

14. The thermal system of claim 13, wherein the heat exchanger is a passenger cabin heat exchanger thermally coupled to the second branch conduit.

15. The thermal system of claim 12, further comprising a thermostat coupled to the high temperature circuit and configured to receive coolant flow from the engine.

16. The thermal system of claim 15, wherein the first branch conduit is fluidly coupled between the thermostat and the main coolant pump.

17. The thermal system of claim 16, wherein the second branch conduit is fluidly coupled between the thermostat and the main coolant pump.

18. A vehicle comprising:

an engine;

a passenger cabin heat exchanger configured to provide heating to a passenger cabin;

a controller; and a thermal system configured to provide passenger cabin heating during an engine stop/start, the thermal system comprising:

a coolant circuit thermally coupled to the engine and the passenger cabin heat exchanger, the coolant circuit including a first loop and a second loop;

a main coolant pump configured to circulate coolant through the coolant circuit; and an auxiliary coolant pump configured to circulate coolant through the first loop and having a housing, an impeller, an internal bypass passage within the housing configured to bypass the impeller, and a one-way valve disposed within the internal bypass passage, wherein the auxiliary coolant pump and the passenger cabin heat exchanger are disposed on the first loop, and a radiator is disposed on the second loop, wherein coolant in the first loop passes through the engine, the auxiliary pump, and the passenger cabin heat exchanger before returning through the main coolant pump, wherein coolant in the second loop passes through the engine and the radiator before returning through the main coolant pump, and wherein the controller is configured to:

selectively turn on the auxiliary coolant pump when the main coolant pump is turned off and the vehicle engine is stopped during a stop/start mode to continue to provide heating to the passenger cabin; and when the main coolant pump is on, selectively turn off the auxiliary coolant pump such that coolant flows through the internal bypass passage to reduce or eliminate restriction of the coolant flow rate in the thermal system.

* * * * *